United States Patent [19]

Ainoz

[11] Patent Number: 4,639,214

[45] Date of Patent: Jan. 27, 1987

[54] LIQUEFIED GAS LIGHTER WITH FLAT FLAME WIDENED IN ITS MEDIAN PART

[75] Inventor: Jean-Philippe Ainoz, Faverges, France

[73] Assignee: S.T.Dupont, Paris, France

[21] Appl. No.: 786,271

[22] Filed: Oct. 10, 1985

[30] Foreign Application Priority Data

Oct. 31, 1984 [FR] France ..... 84 16703

[51] Int. Cl.[4] ..... F23D 14/28

[52] U.S. Cl. ..... 431/344; 239/552; 239/568

[58] Field of Search ..... 431/344, 142, 143, 150, 431/254, 255, 276, 277; 239/552, 568

[56] References Cited

U.S. PATENT DOCUMENTS 2,318,985 5/1943 Baker ..... 239/552
2,525,432 10/1950 Stadler ..... 239/552
3,580,700 5/1971 Hinckley ..... 431/150
3,797,755 3/1974 Saisho ..... 239/552

FOREIGN PATENT DOCUMENTS 122500 10/1984 European Pat. Off. .
1212326 3/1966 Fed. Rep. of Germany .
538093 7/1972 Switzerland .

*Primary Examiner*—Carroll B. Dority, Jr.
*Attorney, Agent, or Firm*—John P. Morley

[57] ABSTRACT

The invention relates to a gas lighter with a flat flame widened in its median part, of the type comprising a burner (22) having two gas exit nozzles (23, 24) with diverging axes. According to the invention, said nozzles have a shape or are disposed such that, at their lower parts, they terminate at a tangent to an adjacent surface of the burner or body of the lighter, licked by the gas flow they emit.

5 Claims, 5 Drawing Figures

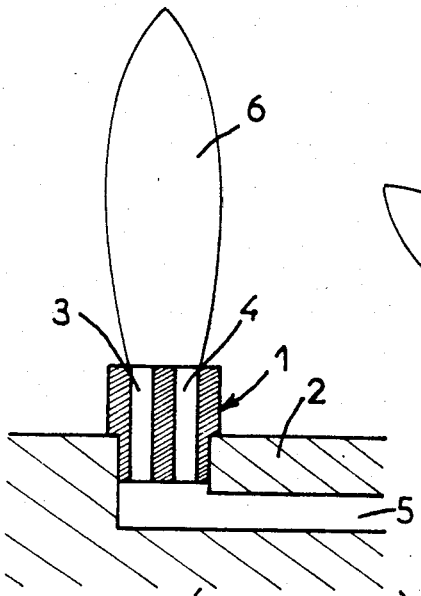
FIG.1 (PRIOR ART)
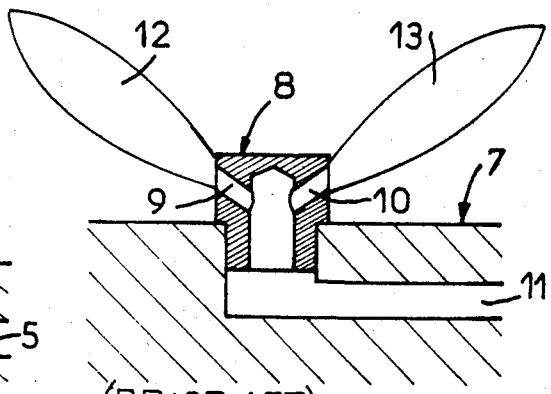
(PRIOR ART) FIG.2
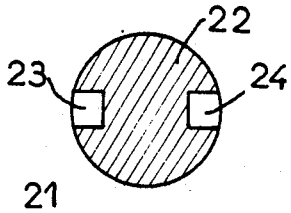
FIG.5
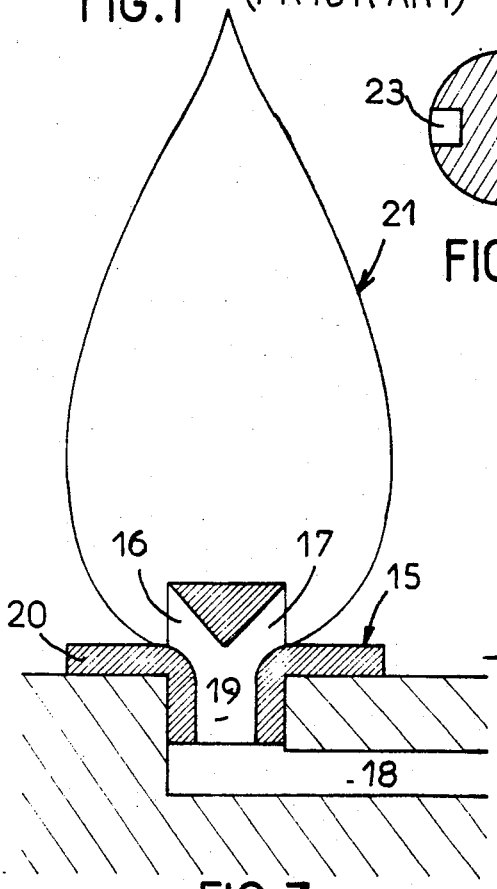
FIG.3
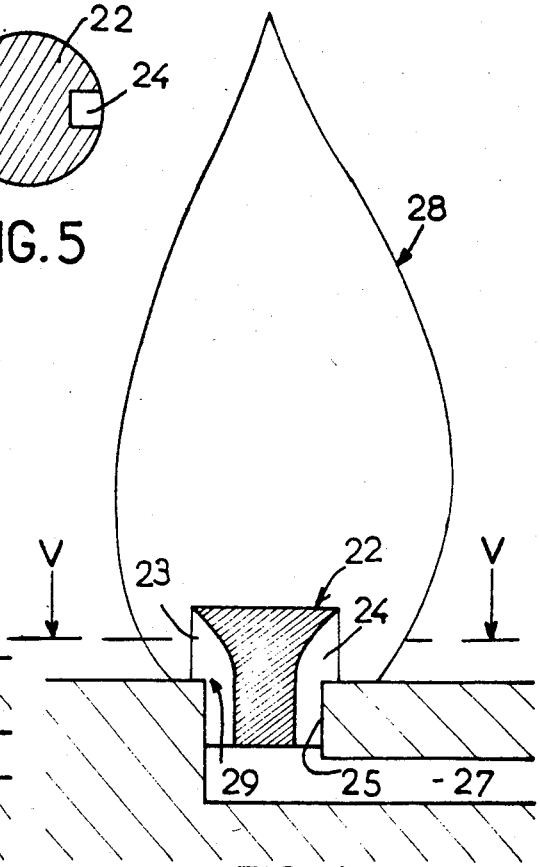
FIG.4

LIQUEFIED GAS LIGHTER WITH FLAT FLAME WIDENED IN ITS MEDIAN PART

The present invention relates to a liquefied gas lighter with a flat flame widened in its median part.

For certain applications, it is desirable to have a lighter whose flame is wider than that of an ordinary lighter. This is the case in particular when it is desired to light a cigar, when a flame widened in its median part is particularly desirable.

In order to widen the flame of a lighter and make it suitable for easy, satisfactory lighting of cigars, several solutions have already been proposed.

The simplest consists of increasing the diameter of the gas outlet nozzle, but this increases the flowrate of the lighter and an elongated, unattractive flame is obtained.

To reduce the flowrate, one possibility is to form flat flames and, for this purpose, so-called "butterfly" burners, inspired by the technique used in acetylene burners, i.e. a two-head burner whose nozzles are separate from each other and inclined in the direction of the burner axis.

The major drawback to this type of burner is its size, since it is necessary to have two separate heads. In addition, manufacture of lighters of this type is relatively complex.

It has thus appeared that a wide-flame lighter with two flames merging to form a single widened flame should have only one burner head from which the two flames would emerge.

Lighters based on this principle have already been made, and they appear in FIGS. 1 and 2 of the attached schematic drawings. In these drawings, which also represent embodiments of the present invention to be described hereinbelow:

FIG. 1 is a partial axial section along the axis of the burner of a lighter with two merged flames in the prior art;

FIG. 2 is a similar section through another two-flame lighter in the prior art;

FIGS. 3 and 4 are partial axial cross sections, along the burner axes, of two lighters according to the invention;

FIG. 5 is a section along line V—V of FIG. 4.

FIGS. 1 and 2 illustrate two lighters in the prior art comprising a burner which gives out two flames which then merge to form a single widened flame.

In the case of FIG. 1, burner 1 of lighter 2 has two bores 3 and 4 with parallel axes, supplied with gas by a single duct 5. Flame 6 thus produced remains relatively narrow, however, as in the prior art, unless the gas flowrate is increased, which has the disadvantage of simultaneously increasing the length of the flame.

Another solution is that illustrated in FIG. 2, where lighter 7 has a burner 8 having two diverging bores 9 and 10, disposed symmetrically with respect to the burner axis and supplied by a single duct 11.

In such a lighter, as long as the gas flowrate is low, the flames emitted by bores 9 and 10 come together very easily to form a relatively wide flame, but one which is very low in height. If the flowrate is then increased to increase the flame height, the two flames 12 and 13 emitted by bores 9 and 10 unfortunately diverge as soon as the gas flowrate reaches a certain threshold and a single, wide flame is no longer obtained.

The goal of the prevent invention is to remedy these drawbacks by proposing a lighter whose flame is flat and wide, and has good stability and satisfactory height, without thereby requiring an excessive gas exit rate and flowrate.

Beginning with the prior art illustrated in FIG. 2, Applicant has noted that separation into two distinct flames, at a high flowrate, of the single flame obtained at a low flowrate has to do with the overly high gas exit rate and Applicant has established that, to overcome this drawback, one need only brake the gas at the outlet of the burner nozzles by causing it to lick an adjacent surface tangentially.

Hence, the subject of the invention is a gas lighter with a flat flame widened in its median part, of the type comprising a burner having two gas outlet nozzles with diverging axes, characterized by said nozzles having shapes or being disposed such that, at their lower part, they terminate at a tangent to an adjacent surface of the burner or lighter body licked by the gas flow they emit.

Hence, the lower part of the gas flow of the nozzles will be braked by the adjacent surfaces and the flames they emit can come together to form only one widened flat flame with satisfactory height and great stability.

Advantageously, the nozzles of the burner are disposed symmetrically with respect to its axis and their upper parts are inclined at least approximately 30° to this axis.

Preferably, in order to increase the braking action exerted on the gas, the nozzles have an internal throttle conferring a converging-diverging profile thereon.

In a first embodiment of a lighter according to the invention, shown in FIG. 3, the surfaces licked by the gas at the outlets of the nozzles belong to the burner itself. This burner 15 has two gas outlet nozzles, 16 and 17, supplied with gas by a common duct 18 provided in the body of the lighter through the intermediary of a central duct 19 of the burner.

Nozzles 16 and 17 are disposed symmetrically with respect to the burner axis and their upper parts are inclined thereto at an angle of 45°.

In accordance with the invention, the burner has a projection 20 whereby it rests on the body of the lighter and at the surface of which projection the lower parts of nozzles 16 and 17 terminate at a tangent. Hence the gas licks the upper surface of projection 20, by which it is braked, which has the effect that the two flames emitted by nozzles 16 and 17 can combine to form a single, flat, wide flame, with a satisfactory height. It will be noted that the central duct 19 communicates with nozzles 16 and 17 via a constriction which confers on the whole a venturi profile favorable to slowing down the gases at the nozzle outlets.

FIG. 4 shows another embodiment of the invention wherein the burner is composed of an essentially cylindrical pin 22 wherein slots 23 and 24 are provided forming gas outlet nozzles, said burner 22 being simply fitted in a recess 25 with a profile complementary to the body of the lighter, supplied with gas by a duct 27. The lower parts of nozzles 23 and 24 are thus composed of the surface of the lighter body, which the gas leaving the burner thus licks.

As before, the gas is braked in this way and the flames emitted by nozzles 23 and 24 merge into a single flat flame 28, wide in its median part. It will be noted that edge 29 of recess 25 forms a throttle inside slots 23 and 24 such that, as a result of the diverging effect, the exiting gas undergoes an increased braking effect which favors a wide, stable flame being obtained.

What is claimed:

1. A gas lighter of the type having a body including a burner nozzle means, the burner nozzle means including only two, relatively closely spaced gas outlets having upper and lower surfaces, said outlets being formed in a common plane and directed in opposite directions, said lower surfaces terminating in downstream directions extending in a common plane and said upper surfaces extending away from the plane of said lower surfaces whereby flame from the gas outlets combines to form a flat flame widened at its median part.

2. A lighter according to claim 1, wherein said burner has an axis perpendicular to the plane of said lower surfaces, said upper surfaces being inclined to said axis by at least 30°.

3. A lighter according to claim 1, wherein said outlets include means forming a throttle.

4. A lighter according to claim 1, wherein the lower surfaces of said nozzle means includes a projection on the lighter body.

5. A lighter according to claim 1, wherein said nozzle means includes a cylinder having two lateral slots and being fitted in the body of the lighter.

* * * * *